US009261806B2

(12) United States Patent
Moribe et al.

(10) Patent No.: US 9,261,806 B2
(45) Date of Patent: Feb. 16, 2016

(54) TONER

(71) Applicant: CANON KABUSHIKI KAISHA, Tokyo (JP)

(72) Inventors: Shuhei Moribe, Mishima (JP); Naoki Okamoto, Mishima (JP); Kosuke Fukudome, Tokyo (JP); Satoshi Mita, Fukuyama (JP); Kunihiko Nakamura, Gotemba (JP); Noriyoshi Umeda, Suntou-gun (JP); Yoshiaki Shiotari, Mishima (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 14/444,989

(22) Filed: Jul. 28, 2014

(65) Prior Publication Data

US 2015/0037728 A1 Feb. 5, 2015

(30) Foreign Application Priority Data

Aug. 1, 2013 (JP) ..... 2013-160758

(51) Int. Cl.
*G03G 9/08* (2006.01)
*G03G 9/087* (2006.01)

(52) U.S. Cl.
CPC ..... *G03G 9/08755* (2013.01); *G03G 9/08791* (2013.01); *G03G 9/08795* (2013.01); *G03G 9/08797* (2013.01)

(58) Field of Classification Search
CPC ..... G03G 9/08755
USPC ..... 430/109.4
See application file for complete search history.

(56) References Cited

U.S. PATENT DOCUMENTS

| | | | |
|---|---|---|---|
| 7,041,422 | B2 | 5/2006 | Shirai et al. |
| 9,116,448 | B2 * | 8/2015 | Terauchi et al. |
| 9,134,637 | B2 * | 9/2015 | Hotta et al. |
| 9,141,012 | B2 * | 9/2015 | Moribe et al. |
| 2003/0224278 | A1 | 12/2003 | Shirai et al. |
| 2013/0171556 | A1 | 7/2013 | Fujikawa et al. |

FOREIGN PATENT DOCUMENTS

| | | | |
|---|---|---|---|
| EP | 2 237 111 | A1 | 10/2010 |
| EP | 2 626 745 | A1 | 8/2013 |
| JP | 2003-337443 | A | 11/2003 |
| JP | 2007-58135 | A | 3/2007 |
| JP | 2008-203779 | A | 9/2008 |
| JP | 2010-107673 | A | 5/2010 |

OTHER PUBLICATIONS

European Search Report dated Dec. 23, 2014 in European Application No. 14179241.6.
U.S. Appl. No. 14/446,971, filed Jul. 30, 2014. Applicant: Kosuke Fukudome, et al.
Robert F. Fedors, "A Method for Estimating Both the Solubility Parameters and Molar Volumes of Liquids", Polymer Engineering and Science, Feb. 1974, vol. 14., No. 2.

* cited by examiner

*Primary Examiner* — Mark A Chapman
(74) *Attorney, Agent, or Firm* — Fitzpatrick, Cella, Harper and Scinto

(57) ABSTRACT

Provided is a toner having excellent long-term storage stability and exhibiting both low-temperature fixability and uniform gloss in high-speed printing. A toner has a toner particle that contains a crystalline polyester resin A, an amorphous polyester resin B and a colorant, wherein the crystalline polyester resin A has a polyester molecular chain having a nucleating agent segment at the terminal end thereof, and an SP value Sa $((cal/cm^3)^{1/2})$ of the crystalline polyester resin A ranges from 9.00 to 11.50, and the amorphous polyester resin B has a specific functional group.

6 Claims, No Drawings

TONER

BACKGROUND OF THE INVENTION

1. Field of the Invention

The present invention relates to a toner for use in electrophotography and in toner jetting and image forming methods for visualizing electrostatic images.

2. Description of the Related Art

The requirements of higher speeds and higher reliably placed on electrophotographic image-forming apparatuses have become more demanding in recent years. Requirements concerning, for instance, power saving and shorter wait times have become likewise more demanding. To meet these demands, toners are required to afford low-temperature fixability in high-speed developing systems.

Fixing performance is ordinarily correlated with toner viscosity, but in high-speed developing systems, in particular, the conventional requirement of fixing performance is compounded with the need for quick melting with a small amount of heat during fixing (so-called sharp melt property).

Japanese Patent Application Publication No. 2007-58135 proposes a toner having improved low-temperature fixability, obtained by bonding, to an amorphous polyester resin, at least one monovalent aliphatic compound selected from the group consisting of monovalent aliphatic carboxylic acid compounds having 10 to 24 carbon atoms and monovalent aliphatic alcohols having 10 to 24 carbon atoms.

When bonded to the amorphous polyester resin, the resulting aliphatic hydrocarbon segment plasticizes the resin, whereby low-temperature fixability is enhanced.

When the toner is stored at high temperature, however, the amorphous polyester segments are gradually plasticized by the aliphatic hydrocarbon segments of high molecular mobility, and heat-resistant storability is impaired as a result. Further, the difference in viscosity between the portions plasticized by the aliphatic hydrocarbon segments and other portions of the amorphous polyester resin increases during hot melting, and gloss unevenness may consequently arise in fixed images. Although the above feature is effective as regards low-temperature fixability, there is thus still significant room from improvement in terms of heat-resistant storability and other properties.

There are numerous reports (for example, Japanese Patent Application Publication No. 2003-337443) on the use of a binder in the form of a crystalline resin instead of an amorphous resin, with a view to imparting a sharp melt property.

As is known, crystalline resins melt rapidly, at about the glass transition temperature, and thus low-temperature fixability can be improved on account of higher compatibility with the amorphous resin.

If the compatibility between the crystalline resin and the amorphous resin is excessively high, however, the heat-resistant storability of the toner becomes poorer and the sharp melt property of the crystalline resin is lost, as a result of which the fixing performance may be impaired in the high-speed developing system.

Accordingly, toners have been proposed (Japanese Patent Application Publications No. 2010-107673 and 2008-203779) which, in terms of controlling compatibility, rely on a combination of a crystalline polyester resin and an amorphous polyester resin having bonded thereto an aliphatic hydrocarbon segment of a certain number of carbon atoms. It has been suggested that a toner having superior fixing performance, storage stability, developing characteristics and so forth can be achieved by virtue of that feature.

Although a certain effect on fixing performance is found to be elicited in all the above instances, it is difficult to reliably avoid a state where the amorphous polyester resin is readily plasticized by the aliphatic hydrocarbon segment that is bonded to the latter. In particular, the heat-resistant storability of the toner may decrease when the toner is left to stand at high temperature over long periods of time.

Thus, no toner has been provided thus far that is sufficiently satisfactory as regards fixing performance during high-speed development, long-term storage stability, high-temperature high-humidity storage stability, and, in addition, gloss uniformity.

SUMMARY OF THE INVENTION

It is an object of the present invention to provide a toner that solves the above problems.

Specifically, it is an object of the present invention to provide a toner boasting excellent long-term storage stability and high-temperature high-humidity storage stability, and exhibiting uniform gloss and good fixing performance in high-speed printing.

The present invention relates to a toner having a toner particle that contains a crystalline polyester resin A, an amorphous polyester resin B and a colorant, wherein the crystalline polyester resin A has a polyester molecular chain having a nucleating agent segment at the terminal end thereof, and has an SP value (Sa) ($(cal/cm^3)^{1/2}$) ranging from 9.00 to 11.50, and the amorphous polyester resin B has at least one functional group selected from the group consisting of (a) to (c):

(a) an aliphatic hydrocarbon group having 8 to 50 carbon atoms;

(b) a functional group of which an aliphatic alcohol having 8 to 50 carbon atoms has been bound by condensation; and (c) a functional group of which an aliphatic carboxylic acid having 9 to 51 carbon atoms has been bound by condensation.

The present invention succeeds in providing a toner boasting excellent long-term storage stability and high-temperature high-humidity storage stability, and exhibiting uniform gloss and good fixing performance in high-speed printing, by combining a crystalline polyester resin A having a nucleating agent segment and exhibiting a high nucleating effect with an amorphous polyester resin B having an aliphatic hydrocarbon functional group.

Further features of the present invention will become apparent from the following description of exemplary embodiments.

DESCRIPTION OF THE EMBODIMENTS

In order to enhance low-temperature fixability in a high-speed developing system, toner must melt rapidly (i.e. the sharp melt property must be enhanced) within the short lapse of time during passage through a nip of a fixing unit. The use of crystalline polyester resins has been studied in recent years with a view to enhancing the sharp melt property. However, controlling the compatibility of crystalline polyester resins with amorphous polyester resins is hard, and it has been heretofore difficult to achieve both fixing performance and heat-resistant storability as desired. Examples of materials that afford sharp melting include, ordinarily, for instance low-molecular weight aliphatic hydrocarbons such as waxes. Imparting this function to the amorphous polyester resin allows the desired low-temperature fixability and heat-resistant storability to be conceivably combined. When using such an amorphous polyester resin, however, the amorphous polyester resin is plasticized by a functional group having an aliphatic hydrocarbon (hereafter also referred to as functional group C), and an adverse effect arises in that heat-resistant storability is impaired, as described above. A further adverse effect occurs in terms of gloss unevenness, in fixed images, derived from melt viscosity unevenness.

The inventors speculated that a desired performance might be achieved when using a material such that, at room temperature, the functional group C is crystallized and plasticization of the amorphous polyester resin is suppressed, whereas in a molten state the entirety of the amorphous polyester resin is plasticized. Specifically, the inventors conjectured that the desired performance could be achieved by adding a material having both a nucleating effect and a plasticizing effect.

In order to crystallize the functional group C, it is necessary to use a material having a structure identical to that of the functional group C but having a faster crystallization rate than that of the functional group C. Further, a material having a certain high degree of compatibility with the amorphous polyester resin must be used in order to plasticize the entirety of the amorphous polyester resin.

In view of the above requirements, it was speculated that both a nucleating effect and a plasticizing effect can be elicited by using a material (crystalline polyester resin A) in which a nucleating agent is bonded to crystalline polyester resin ends.

The crystalline polyester resin A having a nucleating agent is a crystalline polyester resin having an extremely high crystallization rate. This is deemed to arise from the fact that the nucleating agent segment can induce direct crystal growth of the crystalline polyester resin.

Also, the orderliness of molecules is increased, and a crystalline polyester resin of strong nucleating effect is achieved, by controlling the SP value (Sa) of the crystalline polyester resin A of the present invention.

During crystallization, the crystalline polyester resin A having a high crystallization rate and a strong nucleating effect crystallizes selectively around the functional group C of similar structure. As a result, the functional group C forms a crystalline state together with the crystalline polyester resin A before the functional group C is compatibilized with the amorphous polyester resin. It is found that plasticization of the amorphous polyester resin by the functional group C, as described above, is suppressed as a result.

Further, the crystalline polyester resin A forms a crystalline state around the functional group C. It becomes accordingly possible to curtail compatibilization of the crystalline polyester resin and the amorphous polyester resin, which was a conventional concern.

In a room-temperature state, thus, the crystalline polyester resin A forms a crystalline state together with the functional group C, and the heat-resistant storability of the toner as such is enhanced. The functional group C and the amorphous polyester resin, and also the crystalline polyester resin A and the amorphous polyester resin, via the functional group C, plasticize rapidly during hot-melting, at which time molecular motion is activated. It is deemed that a toner having excellent low-temperature fixability and uniform gloss can be provided as a result.

As a characterizing feature, specifically, the toner of the present invention has a crystalline polyester resin A that has a polyester molecular chain having a nucleating agent segment at the terminal end thereof, and that has an SP value (Sa) ranging from 9.00 $(cal/cm^3)^{1/2}$ to 11.50 $(cal/cm^3)^{1/2}$. More preferably, the SP value of the crystalline polyester resin A ranges from 9.70 $(cal/cm^3)^{1/2}$ to 10.20 $(cal/cm^3)^{1/2}$. If there is no nucleating agent segment at the molecular chain ends of the crystalline polyester resin, the functional group C and the amorphous polyester resin are compatibilized, without crystallization of the functional group C, and heat-resistant storability is impaired as a result.

In such a case, moreover, the crystalline polyester resin A cannot heat-melt rapidly via the functional group C, and the plasticization rate of the crystalline polyester resin A and the amorphous polyester resin becomes non-uniform. As a result, gloss unevenness is likelier to occur in fixed images that are fixed in the high-speed developing system.

The crystalline polyester resin A of the present invention has an SP value (Sa) in the above range. The SP value of a resin is an indicator of solubility, but in the present invention is used as indicator of the strength of the nucleating effect. A small SP value denotes that the chain lengths of the alkyl group chains of the aliphatic alcohol and the aliphatic carboxylic acid that make up the crystalline polyester resin A are long. Crystalline polyester resins made up of components having a long alkyl chain have ordinarily few polar groups; accordingly, the resins have higher molecular orderliness, crystallize readily and exhibit a strong nucleating effect.

In a case where the SP value of the crystalline polyester resin A is smaller than 9.00 $(cal/cm^3)^{1/2}$, therefore, polar groups are few, molecular orderliness increases and the nucleating effect is excessively strong. As a result, the crystalline polyester resin A and the functional group C form a strong crystalline state such that in a high-speed developing system, toner cannot melt sufficiently in a short time, and low-temperature fixability decreases. On the other hand, if the SP value of the crystalline polyester resin A is greater than 11.50 $(cal/cm^3)^{1/2}$, polar groups are more numerous, molecular orderliness lower, and the nucleating effect becomes weaker. As a result, the functional group C fails to crystallize sufficiently, and plasticization of the amorphous polyester resin by the functional group C progresses gradually, and heat-resistant storability decreases, upon prolonged storage at high temperature.

The SP value used in the present invention is calculated on the basis of the type and ratios of the monomers that make up a resin, in accordance with an ordinarily used method of which some are described in Fedors "Poly. Eng. Sci., 14 (2) 147 (1974)". The SP value of the crystalline polyester resin A denotes herein the SP value of the polyester molecular chains that comprise the nucleating agent segment.

The SP value can be controlled on the basis of the type and amount of the monomers that are added. For instance, it suffices to add monomers having a large SP value in order to increase the SP value. Conversely, it suffices to add monomers having a small SP value in order to reduce the SP value.

A further characterizing feature of the invention is that the toner contains an amorphous polyester resin B having at least one functional group selected from the group consisting of (a) to (c) below:

(a) an aliphatic hydrocarbon group having 8 to 50 carbon atoms (preferably, 10 to 30 carbon atoms);

(b) a functional group of which an aliphatic alcohol having 8 to 50 carbon atoms (preferably, 10 to 30 to carbon atoms) has been bound by condensation; and (c) a functional group of which an aliphatic carboxylic acid having 9 to 51 carbon atoms (preferably, 11 to 31 to carbon atoms) has been bound by condensation.

Herein, the feature wherein the functional group (functional group C) having an aliphatic hydrocarbon in the amorphous polyester resin B is of a given length is an essential requirement in order to bring on a crystalline state.

The functional group C denotes herein at least one functional group selected from the group consisting of (a) to (c) above.

The functional group C is bonded to the amorphous polyester resin.

For instance, the functional group C can be introduced into the amorphous polyester resin B by:

i) generating radicals in the amorphous polyester resin, as a result of a hydrogen abstraction reaction, to induce a reaction with an aliphatic hydrocarbon having unsaturated bonds;

ii) inducing a condensation reaction of hydroxy groups of the amorphous polyester resin with the aliphatic carboxylic acid; and iii) inducing a condensation reaction of carboxyl groups of the amorphous polyester resin with the aliphatic alcohol.

The functional group C may be branched or linear, but is preferably linear.

One end of the functional group C is bonded to the amorphous polyester resin, but the opposite end is not bonded to the amorphous polyester resin.

The functional group formed in accordance with the method in ii) has the structure —OC(=O)—R, whereas the functional group formed in accordance with the method in iii) has the structure —C(=O)O—R.

The component that constitutes (a) is an unsaturated aliphatic hydrocarbon having 8 to 50 carbon atoms (preferably, 10 to 30 carbon atoms), and is specifically an unsaturated aliphatic hydrocarbon such as 1-octene, 1-decene, 1-dodecene or the like.

The component that constitutes (b) is preferably one or more components selected from among saturated aliphatic monoalcohols and saturated aliphatic dialcohols having 8 to 50 carbon atoms (preferably, 10 to 30 carbon atoms). Examples thereof include, for instance, saturated aliphatic monoalcohols such as 1-octanol, 1-decanol and the like, and saturated aliphatic diols such as 1,8-octanediol, 1,9-nonanediol, 1,10-decanediol and the like.

Preferably, the component that constitutes (c) is one or more components selected from among saturated aliphatic monocarboxylic acids and saturated aliphatic dicarboxylic acid having 9 to 51 carbon atoms (preferably, 11 to 31 carbon atoms). Examples thereof include, for instance, aliphatic monocarboxylic acids such as stearic acid, arachidic acid, behenic acid and the like, as well as saturated aliphatic dicarboxylic acid such as 1,9-nonanedioic acid, 1,10-decanedioic acid, 1,11-undecanedioic acid, 1,12-dodecanedioic acid and the like.

Preferably, the content of the component that constitutes the functional group C is from 2.0 mol % to 11.0 mol % of monomers that constitute the amorphous polyester resin B. Both fixing performance and storability can be both achieved when the above ranges are satisfied.

The degree of crystallinity of the functional group C decreases if the number of carbon atoms of the aliphatic hydrocarbon or the aliphatic alcohol is smaller than 8, or if the number of carbon atoms of the aliphatic carboxylic acid is smaller than 9. The functional group C can be crystallized to some extent using the crystalline polyester resin A; however, the crystallization state of the crystalline polyester resin A and the functional group C is weakened in an moisture-rich environment, where water is a plasticizer. Accordingly, the crystalline state cannot be maintained, and heat-resistant storability decreases, in high-temperature high-humidity environments.

The degree of crystallinity of the functional group C increases if the number of carbon atoms of the aliphatic hydrocarbon or the aliphatic alcohol is larger than 50, or the number of carbon atoms of the aliphatic carboxylic acid is larger than 51. As a result, the crystalline polyester resin A and the functional group C form a strong crystalline state, and low-temperature fixability decreases. Further, the viscosity difference between crystalline sections and amorphous sections becomes pronounced in fixed images, and the fixed images are prone to exhibit gloss unevenness.

As explained above, superior long-term storage stability, regardless of the usage environment, is afforded by combining the crystalline polyester resin A having a nucleating agent segment and having a high nucleating effect, with the amorphous polyester resin B having a specific aliphatic hydrocarbon functional group. It becomes furthermore possible to combine both low-temperature fixability and uniform gloss in high-speed printing.

Preferably, the SP value (Sa) of the crystalline polyester resin A and the SP value (Sb) of the amorphous polyester resin B contained in the toner of the present invention satisfy Expression (1) below.

$$-1.50 \leq Sb - Sa \leq 1.50 \qquad \text{Expression (1)}$$

The SP value (solubility parameter) is used conventionally as an indicator that denotes, for instance, the ease with which resins, or resins and waxes, mix with each other. Herein, Sb−Sa is an indicator of the readiness with which the crystalline polyester resin A and the amorphous polyester resin B are compatibilized during hot melting, i.e. an indicator of how readily phase separation occurs at room temperature. Preferably, the SP values of the resins are controlled so as to lie within the above ranges, to further enhance thereby the heat-resistant storability and the low-temperature fixability over long periods of time.

Herein, Sb−Sa is more preferably $$-0.50 \leq Sb - Sa \leq 0.50.$$

The SP value of the amorphous polyester resin B denotes the SP value of the polyester molecular chains that comprise the functional group C.

The nucleating agent segment in the crystalline polyester resin A is not particularly limited, so long as it is a compound having a higher crystallization rate than that of the crystalline polyester resin. In terms of the feature of having a high crystallization rate, the nucleating agent segment is preferably a compound that comprises a hydrocarbon segment the main chain whereof is linear, and that has a monovalent or higher functional group that can react with the molecular chain ends of the crystalline polyester resin, From the viewpoint of enhancing long-term storage stability, preferred among the foregoing are segments derived from an aliphatic monoalcohol having 10 to 30 carbon atoms and/or an aliphatic monocarboxylic acid having 11 to 31 carbon atoms. In the crystalline polyester resin A, specifically, the nucleating agent segment has preferably a structure that results from condensation of an aliphatic monoalcohol and/or aliphatic monocarboxylic acid at the ends of the crystalline polyester resin.

Examples of aliphatic monoalcohols include, for instance, 1-decanol, stearyl alcohol and behenyl alcohol.

Examples of aliphatic monocarboxylic acids include, for instance, stearic acid, arachidic acid and behenic acid. The molecular weight of the nucleating agent segment ranges preferably from 100 to 10,000, more preferably from 150 to 5,000, in terms of reactivity of the molecular chain ends of the crystalline polyester resin.

Preferably, the content of the nucleating agent segment ranges preferably from 0.1 mol % to 7.0 mol %, more preferably from 0.5 mol % to 4.0 mol %, among the monomers that constitute the crystalline polyester resin A, from the viewpoint of increasing the crystallization rate.

The following analytical procedure is used to determine whether the nucleating agent segment is bonded to the crystalline polyester resin or not.

A sample solution is prepared by exactly weighing 2 mg of a sample, and dissolving the weighed sample in 2 mL of chloroform that are added to the sample. The crystalline polyester resin A is used herein as the resin sample, but toner containing the crystalline polyester resin A can be used, instead of the sample, if the crystalline polyester resin A is difficult to procure. Next, a matrix solution is prepared by weighing exactly 20 mg of 2,5-dihydroxybenzoic acid (DHBA) and dissolving the weighed DHBA in 1 mL of chloroform that is added thereto. Further, an ionization assistant solution is prepared by exactly weighing 3 mg of Na trifluoroacetate (NaTFA) and dissolving thereafter the weighed NaTFA in 1 mL of acetone that is added thereto.

A measurement sample is obtained by mixing 25 μL of the sample solution, 50 μL of the matrix solution and 5 μL of the ionization assistant solution thus prepared, dropping the resulting mixture onto a sample plate for MALDI analysis, and drying the dropped mixture. A mass spectrum is obtained using a MALDI-TOF mass spectrometer (by Bruker Daltonics, Reflex III) as an analyzer. The peaks in an oligomer region (m/Z up to 2,000) in the resulting mass spectrum are assigned, to determine the presence or absence of peaks corresponding to a composition in which the nucleating agent is bonded to molecular ends.

Preferably, the number of carbon atoms C1 of the nucleating agent segment in the crystalline polyester resin A and the number of carbon atoms C2 of the functional group C in the amorphous polyester resin B satisfy Expression (2) below, since in that case crystallization is promoted and long-term storage stability is enhanced.

$$0.5 \leq C1/C2 \leq 3.0 \qquad \text{Expression (2)}$$

In terms of enhancing crystallinity, an aliphatic diol having 6 to 18 carbon atoms is preferably utilized as the alcohol component that is used as a starting monomer of the crystalline polyester resin A. An aliphatic diol having 6 to 12 carbon atoms is preferably used among the foregoing, from the viewpoint of fixing performance and heat-resistant stability. Examples of aliphatic diols include for instance 1,6-hexanediol, 1,7-heptanediol, 1,8-octanediol, 1,9-nonanediol, 1,10-decanediol, 1,11-undecanediol and 1,12-dodecanediol. The content of the aliphatic diol ranges preferably from 80.0 to 100.0 mol % of the alcohol component, in terms of further increasing the crystallinity of the crystalline polyester resin A.

The alcohol component for obtaining the crystalline polyester resin A may contain a polyhydric alcohol component other than the above aliphatic diols. Examples thereof include, for instance, aromatic diols such as alkylene oxide adducts of bisphenol A represented by formula (I), for instance a polyoxypropylene adduct of 2,2-bis(4-hydroxyphenyl)propane or a polyoxyethylene adduct of 2,2-bis(4-hydroxyphenyl)propane; as well as a trivalent or higher alcohol such as glycerin, pentaerythritol and trimethylolpropane.

[Chem. 1]

(I)

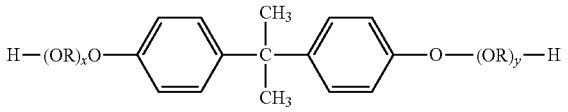

(In the formula, R denotes an alkylene group having 2 or 3 carbon atoms, x and y are positive numbers, such that the sum of x and y ranges from 1 to 16, preferably from 1.5 to 5.)

Preferably, an aliphatic dicarboxylic acid compound having 6 to 18 carbon atoms is used as the carboxylic acid component that is used as a starting monomer of the crystalline polyester resin A. An aliphatic dicarboxylic acid compound having 6 to 12 carbon atoms is preferably used among the foregoing, from the viewpoint of the fixing performance and heat-resistant stability of the toner. Examples of aliphatic dicarboxylic acid compounds include, for instance, 1,8-octanedioic acid, 1,9-nonanedioic acid, 1,10-decanedioic acid, 1,11-undecanedioic acid and 1,12-dodecanedioic acid. The content of the aliphatic dicarboxylic acid compound having 6 to 18 carbon atoms ranges preferably from 80.0 to 100.0 mol % of the carboxylic acid component.

The carboxylic acid component for obtaining the crystalline polyester resin A may contain a carboxylic acid component other than the above aliphatic dicarboxylic acid compound. Examples thereof include, for instance, an aromatic dicarboxylic acid compound, and a trivalent or higher aromatic polyvalent carboxylic acid compound, but the carboxylic acid component is not particularly limited. The aromatic dicarboxylic acid compound includes aromatic dicarboxylic acid derivatives. Specific examples of the aromatic dicarboxylic acid compound include, for instance, aromatic dicarboxylic acids such as phthalic acid, isophthalic acid and terephthalic acid, anhydrides of these acids, and alkyl (having 1 to 3 carbon atoms) esters thereof. Examples of alkyl groups contained in the alkyl esters include, for instance, methyl groups, ethyl groups, propyl groups and isopropyl groups. Examples of the trivalent or higher polyvalent carboxylic acid compound include, for instance, aromatic carboxylic acids such as 1,2,4-benzenetricarboxylic acid (trimellitic acid), 2,5,7-naphthalenetricarboxylic acid and pyromellitic acid, as well as derivatives thereof such as anhydrides and alkyl (having 1 to 3 carbon atoms) esters.

the molar ratio of the alcohol component and the carboxylic acid component being the starting monomers of the crystalline polyester resin A (carboxylic acid component/alcohol component) ranges preferably from 0.80 to 1.20.

The weight-average molecular weight Mwa of the crystalline polyester resin A ranges preferably from 8,000 to 100,000, more preferably from 12,000 to 45,000, from the viewpoint of low-temperature fixability and heat-resistant storability.

Preferably, the crystalline polyester resin A used in the present invention has a heat of fusion (AH) ranging from 100 J/g to 140 J/g as worked out on the basis of the surface area of an endothermic peak observed during temperature raising in a measurement using a differential scanning calorimeter (DSC).

The melting point of the crystalline polyester resin A ranges preferably from 60° C. to 120° C., more preferably from 70° C. to 90° C., from the viewpoint of the low-temperature fixability of the toner.

The acid value of the crystalline polyester resin A ranges preferably from 2 mg KOH/g to 40 mg KOH/g, in terms of bringing out good charging characteristics in the toner.

Examples of the alcohol component for obtaining the amorphous polyester resin portion (amorphous portion) of the amorphous polyester resin B include the alcohol components below. Examples of divalent alcohol components include, for instance, alkylene oxide adducts of bisphenol A represented by the above formula (I), such as polyoxypropylene adducts of 2,2-bis(4-hydroxyphenyl)propane and polyoxyethylene adducts of 2,2-bis(4-hydroxyphenyl)propane, and also ethylene glycol, 1,3-propylene glycol and neopentyl glycol. Examples of trivalent or higher alcohol components include, for instance, sorbitol, pentaerythritol and dipentaerythritol. The above divalent alcohol components and trivalent or higher polyhydric alcohol components can be used singly or as a combination of a plurality of compounds.

Examples of the carboxylic acid component include, for instance, the following. Examples of divalent carboxylic acid components include maleic acid, fumaric acid, phthalic acid, isophthalic acid, terephthalic acid, succinic acid, adipic acid, n-dodecenylsuccinic acid, and anhydrides or lower alkyl esters of these acids. Examples of trivalent or higher polyvalent carboxylic acid components include, for instance, 1,2,4-benzenetricarboxylic acid, 2,5,7-naphthalenetricarboxylic acid, pyromellitic acid, EMPOL trimer acid, and anhydrides or lower alkyl esters of these acids.

The amorphous polyester resin B can be produced by an esterification reaction or a transesterification reaction using the alcohol component and the carboxylic acid component, and also the component that makes up the functional group C. A known esterification catalyst or the like such as dibutyltin oxide can be appropriately used in condensation polymerization to accelerate the reaction.

In a case where the constituent component of the functional group C is (b) and/or (c), preferably, the (b) and/or (c) component is charged, and condensation polymerization is performed after generation of the amorphous portion through condensation polymerization.

The glass transition temperature (Tg) of the amorphous polyester resin B ranges preferably from 45° C. to 75° C., from the viewpoint of low-temperature fixability and heat-resistant storability. The softening point of the amorphous polyester resin B ranges preferably from 80° C. to 150° C., from the viewpoint of the low-temperature fixability of the toner.

In terms of low-temperature fixability and heat-resistant storability, the weight-average molecular weight Mwb of the amorphous polyester resin B ranges preferably from 8,000 to 1,000,000, preferably from 40,000 to 300,000.

The acid value of the amorphous polyester resin B ranges preferably from 2 mg KOH/g to 40 mg KOH/g in terms of bringing out good charging characteristics in the toner.

The mass ratio of the crystalline polyester resin A and the amorphous polyester resin B (resin A:resin B) in the toner ranges preferably from 5:95 to 40:60, more preferably from 8:92 to 30:70, from the viewpoint of low-temperature fixability and long-term storage stability of images.

The softening point of the toner that utilizes the above resins ranges preferably from 80° C. to 120° C., from the viewpoint of the low-temperature fixability of the toner. The weight-average molecular weight of the toner ranges preferably from 3,000 to 500,000, from the viewpoint of fixing performance and hot offset prevention.

A wax may be used in the toner, as needed, in order to improve the releasability of the toner. The wax is preferably hydrocarbon wax such as low-molecular weight polyethylene, low-molecular weight polypropylene, microcrystalline wax or paraffin wax, from the viewpoint of facilitating dispersion in the toner and affording high releasability. Two or more types of wax may be used concomitantly, as needed.

Specific examples of the wax include, for instance, the following: VISKOL (registered trademark) 330-P, 550-P, 660-P and TS-200 (by Sanyo Chemical Industries, Ltd.), Hi-wax 400P, 200P, 100P, 410P, 420P, 320P, 220P, 210P and 110P (by Mitsui Chemicals, Inc.), Sasol H1, H2, C80, C105 and C77 (by Schumann Sasol GmbH), HNP-1, HNP-3, HNP-9, HNP-10, HNP-11 and HNP-12 (by NIPPON SEIRO CO., LTD.), UNILIN (registered trademark) 350, 425, 550 and 700, UNICID (registered trademark) 350, 425, 550 and 700 (by Toyo Petrolite Co., Ltd.), Japan wax, bees wax, rice wax, candelilla wax and carnauba wax (by CERARICA NODA Co., Ltd.).

If the toner is produced in accordance with a pulverization method, the wax is preferably added during melt-kneading. The wax may be added during production of the amorphous polyester resin B. The content of the wax ranges preferably from 1.0 part by mass to 20.0 parts by mass with respect to 100.0 parts by mass of the crystalline polyester resin A and the amorphous polyester resin B.

The toner of the present invention may be a magnetic toner or a non-magnetic toner. When used as a magnetic toner, a magnetic iron oxide can be used as a magnetic body and a colorant. Examples of magnetic iron oxides include, for instance, iron oxides such as magnetite, maghematite and ferrite. The content (as a colorant) of the magnetic iron oxide in the toner ranges preferably from 25.0 parts by mass to 45.0 parts by mass, more preferably from 30.0 parts by mass to 45.0 parts by mass, with respect to 100.0 parts by mass as the total of the crystalline polyester resin A and the amorphous polyester resin B.

If the toner of the present invention is used as a non-magnetic toner, a known pigment or dye such as carbon black can be used as the colorant. The pigment or dye may be used as a single type alone; alternatively, two or more types can be used concomitantly. The content of colorant in the toner ranges preferably from 0.1 part by mass to 60.0 parts by mass, more preferably from 0.5 parts by mass to 50.0 parts by mass, with respect to 100.0 parts by mass as the total of the crystalline polyester resin A and the amorphous polyester resin B.

A flowability improver such as an inorganic fine powder can be used in the toner. Examples of flowability improvers include, for instance, the following; fluororesin powders such as a vinylidene fluoride fine powder or a polytetrafluoroethylene fine powder; fine powder silica such as wet-process silica or dry-process silica; and treated silica obtained by subjecting such silica to a surface treatment with a silane coupling agent, a titanium coupling agent, a silicone oil or the like. Preferred examples of the flowability improver include dry-process silica and fumed silica, which are fine powders produced by vapor phase oxidation of a silicon halide compound.

Among the foregoing there is preferably used a treated silica fine powder resulting from performing a hydrophobic treatment on a silica fine powder produced through vapor phase oxidation of a silicon halide compound. The titrated degree of hydrophobization of the treated silica fine powder in a methanol titration test ranges preferably from 30 to 98.

Examples of the hydrophobization method of the silica fine powder include, for instance, methods that involve chemical treatment with an organosilicon compound that reacts with, or physically adsorbs onto, the silica fine powder. In a preferred method, a silica fine powder produced through vapor-phase oxidation of a silicon halide compound is treated with an organosilicon compound. Examples of the organosilicon compound include, for instance, the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethyldichlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane and dimethyl polysiloxane having 2 to 12 siloxane units per molecule and having one hydroxyl group bonded to Si in each of the units positioned at the ends. The foregoing organosilicon compounds are used singly or in the form of mixtures of two or more types.

The silica fine powder may be treated with a silicone oil, or with both a silicone oil and the above organosilicon compound. The viscosity at 25° C. of the silicone oil ranges preferably from 30 $mm^2/s$ to 1,000 $mm^2/s$. Examples thereof include, for instance, dimethyl silicone oil, methyl phenyl silicone oil, α-methyl styrene-modified silicone oil, chlorophenyl silicone oil and fluorine-modified silicone oil.

Examples of methods for performing a hydrophobic treatment of the silica fine powder using a silicone oil include, for instance, the following: a method in which a silicone oil and a silica fine powder having been treated with a silane coupling agent are directly mixed with each other in a mixer such as a Henschel mixer, and a method in which a silicone oil is sprayed onto a silica fine powder as a base. In another method, silicone oil is dissolved or dispersed in an appropriate solvent, after which the silica fine powder is added to, and mixed with, the resulting solution or dispersion, followed by solvent removal. More preferably, the silicone oil-treated silica is heated, after treatment with the silicone oil, at a temperature of 200° C. or higher (more preferably, 250° C. or higher) in an inert gas, to stabilize the surface coat.

The flowability improver is used in an amount that ranges preferably from 0.1 part by mass to 8.0 parts by mass, more preferably from 0.1 part by mass to 4.0 parts by mass, with respect to 100.0 parts by mass of toner particles.

Some other external additive may be added to the toner, as the case may require. Examples of external additives include, for instance, resin microparticles and inorganic microparticles that serve as charging adjuvants, conductivity-imparting agents, caking inhibitors, release agents for heat rollers, lubricants, and abrasives.

Examples of lubricants include, for instance, polyethylene fluoride powder, zinc stearate powder and polyvinylidene fluoride powder. Preferred among the foregoing is polyvinylidene fluoride powder. Examples of the abrasive include, for instance, cerium oxide powder, silicon carbide powder, and strontium titanate powder.

The toner of the present invention may be used as a one-component developer, but can also be used as a two-component developer by being mixed with a magnetic carrier. As the magnetic carrier there can be used known carriers such as a ferrite carrier or a magnetic-body dispersed resin carrier (referred to as a resin carrier) in which a magnetic body is dispersed in a binder resin. If the toner is used as a two-component developer by being mixed with a magnetic carrier, the toner concentration in the developer ranges preferably from 2 mass % to 15 mass %.

The method for producing the toner of the present invention is not particularly limited, but is preferably a pulverization method, from the viewpoint of achieving a toner having better low-temperature fixability. A pulverization method is preferred herein since in a melt-kneading process of the process, the materials are mixed while under shearing, as a result of which the molecular chains of the crystalline polyester resin A intrude readily into the amorphous polyester resin B, and a crystalline state with the functional group C is readily brought about. A process for producing obtaining the toner of the present invention in accordance with a pulverization method will be explained next.

In a raw-material mixing process, for instance the crystalline polyester resin A, the amorphous polyester resin B and the colorant, as the materials that make up the toner particles, and, as needed, other additives, are weighed in predetermined amounts, and are blended and mixed. Specific examples of mixers include, for instance, double cone mixers, V-type mixers, drum-type mixers, super mixers, Henschel mixers, Nauta mixers and Mechano Hybrid (by NIPPON COKE & ENGINEERING. CO., LTD.).

Next, the mixed materials are melt-kneaded, to disperse thereby the colorant and so forth in the crystalline polyester resin A and the amorphous polyester resin B. A pressure kneader, a batch kneader such as a Banbury mixer, or a continuous kneading machine can be used in the melt-kneading process. Single-screw or twin-screw extruders have become mainstream on account of their superiority in terms of enabling continuous production. Specific examples thereof include, for instance, a KTK twin-screw extruder (by KOBE STEEL, LTD.), a TEM twin-screw extruder (by TOSHIBA MACHINE CO., LTD), a PCM kneader (by Ikegai Corp.), a twin-screw extruder (by KCK Co. Ltd.), a co-kneader (by Buss) and Kneadex (by NIPPON COKE & ENGINEERING. CO., LTD.). Furthermore, a resin component resulting from melt-kneading may be rolled using two rolls or the like, and be cooled with water or the like in a cooling process.

The cooled product of the resin component is pulverized down to a desired particle size, in a pulverization process. In the pulverization process, for instance the cooled product of the resin component is coarsely pulverized in a grinder such as a crusher, a hammer mill or a feather mill, followed by fine pulverization in a pulverizer such as, for instance, a Criptron system (by Kawasaki Heavy Industries, Ltd.), Super Rotor (by Nisshin Engineering Inc.), Turbo mill (by Turbo Kogyo Co., Ltd.) or an air-jet type pulverizer. Thereafter, the ground product thus obtained is classified, as the case may require, using a classifier or a screen classifier, for instance Elbow-Jet (by Nittetsu Mining Co., Ltd.) relying on an inertial classification system, Turboplex (by HOSOKAWA MICRON CORPORATION) relying on a centrifugal classification system, TSP separator (by HOSOKAWA MICRON CORPORATION) or Faculty (by HOSOKAWA MICRON CORPORATION), to yield toner particles.

After pulverization, the toner particles can be subjected, as the case may require, to a surface treatment such as a spheroidizing treatment, using a hybridization system (by NARA Machinery Co., Ltd.), a mechanofusion system (by HOSOKAWA MICRON CORPORATION), Faculty (by HOSOKAWA MICRON CORPORATION) or Meteo Rainbow MR-Type (by Nippon Pneumatic Mfg. Co., Ltd.).

Desired additives can be further thoroughly mixed with the toner particles, as needed, using a mixer such as a Henschel mixer or the like.

Methods for measuring the physical properties of the crystalline polyester resin A, the amorphous polyester resin B and the toner are explained next. The physical property values in the working examples described below are measured also on the basis of these methods.

<Measurement of Weight-Average Molecular Weight by Gel Permeation Chromatography (GPC)>

A column is stabilized in a heat chamber at 40° C., and tetrahydrofuran (THF), as a solvent, is caused to flow in the column at that temperature, at a flow rate of 1 mL per minute. Then, about 100 μL of a THF sample solution are injected for measurement. To measure the molecular weight of the sample, a molecular weight distribution of the sample is calculated on the basis of a relationship between count values and logarithms of a calibration curve created using several monodisperse polystyrene standard samples. As the standard polystyrene samples utilized for creating the calibration curve there are used for instance standard polystyrene samples having molecular weights of about $10^2$ to $10^7$, by TOSOH CORPORATION or by Showa Denko K. K. Herein it is appropriate to use at least ten standard polystyrene samples. An RI (refractive index) detector is used as the detector. A combination of a plurality of commercially available polystyrene gel columns may be used as the column. Examples of such combinations include, for instance, a combination of Shodex GPC KF-801, 802, 803, 804, 805, 806, 807 and 800P, by Showa Denko K. K., and a combination of TSK gel G1000H($H_{XL}$), G2000H($H_{XL}$), G3000H($H_{XL}$), G4000H($H_{XL}$), G5000H($H_{XL}$), G6000H($H_{XL}$), G7000H ($H_{XL}$) and TSK guard column, by TOSOH CORPORATION.

Samples are prepared as follows.

Each sample is placed in THF, the whole is left to stand at 25° C. for several hours, and is thereafter thoroughly shaken to elicit good mixing of the sample with THF (until the coalesced body of the sample vanishes). The resulting sample is further left to stand for 12 hours or longer. The time over which the sample is in THF is set to 24 hours. Thereafter, the sample is run through a sample treatment filter (having a pore size ranging from 0.2 μm to 0.5 μm, for instance Mishoridisk H-25-2 (by TOSOH CORPORATION)), to yield a filtrate as the sample for GPC. The sample concentration is adjusted in such a manner that the resin component ranges from 0.5 mg/mL to 5.0 mg/mL.

<Measurement of the Melting Point and Heat of Fusion of the Crystalline Polyester Resin a and the Wax>

To measure the melting point of the crystalline polyester resin A and the wax, the peak temperature of the maximum endothermic peak in a DSC curve measured according to ASTM D3418-82 using a differential scanning calorimeter "Q2000" (by TA Instruments) is taken as a melting point, and the quantity of heat worked out from the surface area of the peak yields the heat of fusion.

The melting points of indium and zinc are used for temperature correction in the detection unit of the instrument, and the heat of fusion of indium for correction of the quantity of heat. Specifically, about 2 mg of the sample are weighed exactly, the weighed sample is placed in an aluminum pan, and measurements are performed within a measurement range of 30 to 200° C. at a ramp rate of 10° C./min, using an empty aluminum pan as a reference. In the measurement, the temperature is raised once up to 200° C., is then lowered to 30° C., and is thereafter raised once more. The maximum temperature of an endothermic peak of a DSC curve within the temperature range of 30 to 200° C. in this second temperature-raising process yields the melting point, and the quantity of heat worked out on the basis of the surface area of the peak yields the heat of fusion.

<Measurement of the Glass Transition Temperature (Tg) of the Amorphous Polyester Resin B>

The Tg of the amorphous polyester resin B is measured in accordance with ASTM D3418-82 using a differential scanning calorimeter "Q2000" (by TA Instruments). The melting points of indium and zinc are used for temperature correction in the detection unit of the instrument, and the heat of fusion of indium for correction of the quantity of heat. Specifically, about 2 mg of the sample are weighed exactly, the weighed sample is placed in an aluminum pan, and measurements are performed within a measurement range of 30 to 200° C. at a ramp rate of 10° C./min, using an empty aluminum pan as a reference. In the measurement, the temperature is raised once up to 200° C., is then lowered to 30° C., and is thereafter raised once more. A change in specific heat is obtained in a temperature range of 40° C. to 100° C. of this second temperature-raising process. The intersection of a differential thermal curve with a line passing through an intermediate point of a base line, before and after occurrence of the change in specific heat, yields the glass transition temperature Tg of the amorphous polyester resin B.

<Measurement of the Softening Point of the Amorphous Polyester Resin B and the Toner>

The softening point of the amorphous polyester resin B and the toner is measured using a constant-load extruding capillary rheometer, "Flow characteristic evaluating apparatus, Flow Tester CFT-500D" (by Shimadzu Corporation) according to the manual that comes with the apparatus. In this apparatus, a measurement sample that fills a cylinder is warmed and melted while under application of a constant load by a piston from above the measurement sample, and the molten measurement sample is extruded through a die at the bottom of the cylinder. A flow curve can then be obtained that denotes the relationship between the temperature and the piston drop amount.

The softening point herein is the "melting temperature at ½-process" as described in the manual of the "Flow characteristic evaluating apparatus, Flow Tester CFT-500D". The melting temperature at ½-process is calculated as follows. Firstly, there is worked out ½ of the difference between a drop amount Smax of the piston at the point in time where outflow of the sample is complete and a drop amount 5 min of the piston at the point in time where outflow of the sample begins (this difference will be referred to as X, i.e. X=(Smax−Smin)/2). The temperature on the flow curve at a time where the drop amount of the piston is equal to the sum of X and 5 min is the ½-process melting temperature.

The measurement sample that is used is a cylindrical sample, having a diameter of about 8 mm, obtained through compression-molding of about 1.0 g of the sample using a tablet compressing machine (for instance, NT-100H, by NPa SYSTEM CO., LTD.) at about 10 MPa, for about 60 seconds, in an environment at 25° C.

The measurement conditions of CFT-500D are as follows:

Test mode: temperature rise method

Ramp rate: 4° C./min

Starting temperature: 50° C.

Saturated temperature: 200° C.

<Measurement of the Acid Value of the Crystalline Polyester Resin a and the Amorphous Polyester Resin B>

The acid value is the number of mg of potassium hydroxide necessary to neutralize the acid in 1 g of sample. The acid value of polyester resins is measured in accordance with JIS K 0070-1992, and specifically in accordance with the procedure below.

(1) Reagent Preparation

A phenolphthalein solution is obtained by dissolving 1.0 g of phenolphthalein in 90 mL of ethyl alcohol (95 vol %) and adding deionized water, to a total amount of 100 mL.

Further, 7 g of special-grade potassium hydroxide are dissolved in 5 mL of water, and ethyl alcohol (95 vol %) is added thereto, to a total amount of 1 L. The resulting solution is placed in an alkali-resisting vessel in such a way so as not to come into contact with carbon dioxide gas and the like, is left to stand for 3 days, and is filtered thereafter to yield a potassium hydroxide solution. The obtained potassium hydroxide solution is stored in an alkali-resisting vessel. To work out the factor of the potassium hydroxide solution, 25 mL of 0.1 mol/L hydrochloric acid are placed in an Erlenmeyer flask, several drops of the phenolphthalein solution are added thereto, and the resulting solution is titrated with the potassium hydroxide solution. The factor is then worked out on the basis of the amount of the potassium hydroxide solution necessary for neutralization. The 0.1 mol/L hydrochloric acid that is used is prepared according to JIS K 8001-1998.

(2) Operation (A) Main Test

A sample of a pulverized polyester resin is weighed exactly, in an amount of 2.0 g, and the weighed sample is placed in a 200 mL Erlenmeyer flask; thereupon, 100 mL of a mixed solution of toluene/ethanol (2:1) are added thereto, to dissolve the sample over 5 hours. Next, several drops of the phenolphthalein solution are added as an indicator, and the resulting solution is titrated with the potassium hydroxide solution. The end point of the titration is herein the point in time by which the pale red color of the indicator has persisted for about 30 seconds.

(B) Blank Test

Titration is performed in the same manner as described above but herein no sample is used (i.e. only the mixed solution of toluene/ethanol (2:1) is used).

(3) the Acid Value is Calculated by Substituting the obtained results in the following expression $$A=[(C-B)\times f\times 5.61]/S$$

In the explanation, A is the acid value (mg KOH/g), B is the amount (mL) of potassium hydroxide solution added in the blank test, C is the amount (mL) of potassium hydroxide solution added in the main test, f is the factor of the potassium hydroxide solution, and S is the weight (g) of the sample.

<Method for Measuring the Weight-Average Particle Diameter (D4)>

The weight-average particle diameter (D4) of toner is calculated through analysis of measurement data obtained over 25,000 effective measurement channels, using a precision particle size distribution measuring apparatus equipped with a 100 μm aperture tube, "Coulter Counter Multisizer 3" (registered trademark, by Beckman Coulter, Inc.) in accordance with an aperture electric resistance method, and using the associated dedicated software for setting measurement conditions and analyzing measurement data "Beckman Coulter Multisizer 3 Version 3.51" (by Beckman Coulter, Inc.).

A solution obtained by dissolving special-grade sodium chloride in deionized water to a concentration of about 1 mass %, such as "ISOTON II" (by Beckman Coulter, Inc.), can be utilized herein as the aqueous electrolyte solution that is used for measurement.

The dedicated software is set up as follows before measurement and analysis.

In a "screen for modifying the standard operation method (SOM)" of the dedicated software, the total count number in the control mode is set to 50,000 particles, the number of measurements is set to one, and a Kd value is set to a value obtained using "standard particles of 10.0 μm" (Beckman Coulter, Inc.). A threshold value and a noise level are automatically set by pressing a threshold value/noise level measurement button. Current is set to 1600 μA, gain is set to 2, electrolyte solution is set to ISOTON II, and a checkbox of flush aperture after the measurement is checked.

In a "screen for setting conversion from pulses to particle size" of the dedicated software, a bin interval is set to logarithmic particle size, the number of particle size bins is set to 256, and the particle size range is set to 2 μm to 60 μm.

The specific measuring method is as follows.

1. About 200 mL of the above aqueous electrolyte solution are charged in a 250 mL round bottom glass beaker designed for use with Multisizer 3, the beaker is placed in a sample stand, and the beaker is stirred counterclockwise, at 24 rotations per second, using a stirrer rod. Dirt and air bubbles within the aperture tube are removed with the help of an "aperture flush" function of the analysis software.

2. About 30 mL of the above aqueous electrolyte solution are charged in a 100 mL flat bottom glass beaker. To the aqueous electrolyte solution there are then added about 0.3 mL of a diluted solution of "Contaminon N" as a dispersing agent (10 mass % pH-7 neutral aqueous solution of a detergent for cleaning precision measurement instruments, containing a nonionic surfactant, an anionic surfactant and an organic builder, by Wako Pure Chemical Industries), diluted three-fold by mass with deionized water.

3. A predetermined amount of deionized water is charged in the water tank of an "Ultrasonic Dispersion System Tetora 150" (Nikkaki Bios Co., Ltd.), which is an ultrasonic disperser having an electrical output of 120 W and having built thereinto two oscillators (oscillation frequency 50 kHz, phases mutually offset by 180°). Then about 2 mL of the above Contaminon N are added to the water tank.

4. The beaker in step 2 above is set in a beaker fixing hole of the ultrasonic disperser, and the ultrasonic disperser is started. The height position of the beaker is adjusted in such a manner that the resonant state of the liquid level of the aqueous electrolyte solution in the beaker is maximal.

5. Then about 10 mg of the toner are added, in small aliquots, to the aqueous electrolyte solution of step 4 in the beaker, while the aqueous electrolyte solution is irradiated with ultrasounds, to disperse the toner. The ultrasonic dispersion treatment is continued for a further 60 seconds. The water temperature in the water tank is appropriately controlled during ultrasonic dispersion so as to range from 10° C. to 40° C.

6. The aqueous electrolyte solution of step 5 having the toner dispersed therein is added drop-wise, using a pipette, to the round bottom beaker of step 1 above that is disposed in the sample stand, and the measurement concentration is adjusted to about 5%. The measurement is then performed until the number of measured particles reaches 50,000.

7. The measurement data is analyzed using the above-described dedicated software ancillary to the apparatus, to calculate the weight-average particle diameter (D4). The "average size" displayed in an analysis/volume statistical value (arithmetic mean) screen, with graph/volume % as set in the dedicated software, corresponds herein to the weight-average particle diameter (D4).

EXAMPLES

In the Examples below, the term "parts" denotes parts by mass.

<Production of Crystalline Polyester Resin A1>

A reaction vessel equipped with a nitrogen introducing tube, a dewatering tube, a stirrer and a thermocouple was charged with 1,10-decanediol, as an alcohol monomer, and 1,10-decanedioic acid, as a carboxylic acid monomer, in the amounts given in Table 1. Tin dioctylate, as a catalyst, was then added in an amount of 1 part by mass with respect to 100 parts by mass of the total amount of monomers. The resulting solution was heated at 140° C. in a nitrogen atmosphere, to carry out a reaction under normal pressure for 6 hours while water was distilled off. Next, the reaction was carried out while raising the temperature to 200° C. at 10° C./hr. Once the temperature reached 200° C., the reaction was left to proceed for 2 hours; thereafter, the interior of the reaction vessel was depressurized to 5 kPa or less, and the reaction was carried out for 3 hours at 200° C.

The pressure in the reaction vessel was then gradually released to be restored to normal pressure, after which a nucleating agent (n-octadecanoic acid) given in Table 1 was added, and the reaction was conducted at 200° C. under normal pressure for 2 hours. Thereafter, the pressure within the reaction vessel was lowered again to 5 kPa or less, and the reaction was carried out at 200° C. for 3 hours, to yield as a result crystalline polyester resin A1. A peak derived from a composition of n-octadecanoic acid bonded to molecular ends of the crystalline polyester resin was observed in a MALDI-TOF mass spectrum of the obtained crystalline polyester resin A1. This revealed therefore that the molecular end of the crystalline polyester resin and the nucleating agent were bonded. The physical properties of crystalline polyester resin A1 are given in Table 2.

<Production of Crystalline Polyester Resins A2 to A11>

Crystalline polyester resins A2 to A11 were obtained in the same way as in crystalline polyester resin A1, but herein the monomers, nucleating agents and use amounts were modified as set out in Table 1. Peaks of compositions of the nucleating agents bonded to the molecular ends were observed in the MALDI-TOF mass spectra of resins A2 to A7, resin A9 and resin A10. This revealed that the molecular ends and the nucleating agents were bonded to each other.

The physical properties of crystalline polyester resins A2 to A11 are given in Table 2.

TABLE 1

| | monomer composition | | | | | | | | | | |
|---|---|---|---|---|---|---|---|---|---|---|---|
| | | addition | | | | addition | nucleating agent | | | addition | |
| | alcohol component | SP value | amount (mol %) | acid component | SP value | amount (mol %) | name | carbon number | SP value | amount (mol %) |
| crystalline polyester resin A1 | 1,10-decanediol | 9.84 | 49.0 | 1,10-decanedioic acid | 9.97 | 49.0 | n-octadecanoic acid | 18 | 8.40 | 2.0 |
| crystalline polyester resin A2 | 1,10-decanediol | 9.84 | 49.0 | 1,8-octanedioic acid | 10.41 | 49.0 | 1-octadecanol | 18 | 8.82 | 2.0 |
| crystalline polyester resin A3 | 1,10-decanediol | 9.84 | 49.0 | 1,12-dodecanedioic acid | 9.66 | 49.0 | n-octadecanoic acid | 18 | 8.40 | 2.0 |
| crystalline polyester resin A4 | 1,10-decanediol | 9.84 | 48.0 | 1,6-hexanedioic acid | 11.10 | 48.0 | n-dodecanoic acid | 12 | 8.58 | 4.0 |
| crystalline polyester resin A5 | 1,18-octadecanediol | 9.08 | 49.0 | 1,18-octadecanedioic acid | 9.14 | 49.0 | n-octacosanoic acid | 28 | 8.26 | 2.0 |
| crystalline polyester resin A6 | 1,9-nonanediol | 10.02 | 49.0 | fumaric acid | 12.83 | 49.0 | n-octanoic acid | 8 | 8.83 | 2.0 |
| crystalline polyester resin A7 | 1,18-octadecanediol | 9.08 | 49.7 | 1,18-octadecanedioic acid | 9.14 | 49.8 | n-dotriacontanoic acid | 32 | 8.23 | 0.5 |
| crystalline polyester resin A8 | 1,9-nonanediol | 10.02 | 50.0 | 1,10-decanedioic acid | 9.97 | 50.0 | — | — | — | — |
| crystalline polyester resin A9 | 1,6-hexanediol | 10.83 | 49.0 | fumaric acid | 12.83 | 49.0 | n-octanoic acid | 8 | 8.83 | 2.0 |
| crystalline polyester resin A10 | 1,18-octadecanediol | 9.08 | 40.0 | 1,18-octadecanedioic acid | 9.14 | 40.0 | n-dotriacontanoic acid | 32 | 8.23 | 20.0 |
| crystalline polyester resin A11 | 1,6-hexanediol<br>2,3-butanediol | 10.83<br>11.77 | 46.2<br>5.1 | maleic acid<br>trimellitic acid | 12.83<br>11.37 | 46.2<br>2.5 | — | — | — | — |

TABLE 2

| | physical properties | | | | |
|---|---|---|---|---|---|
| | SP value (cal/cm$^3$)$^{1/2}$ | melting point ° C. | ⊿H J/g | weight-average molecular weight Mwa | acid value mgKOH/g |
| crystalline polyester resin A1 | 9.87 | 76 | 125 | 19000 | 2 |
| crystalline polyester resin A2 | 10.10 | 74 | 125 | 19000 | 2 |
| crystalline polyester resin A3 | 9.72 | 78 | 125 | 19000 | 2 |
| crystalline polyester resin A4 | 10.39 | 71 | 115 | 17000 | 3 |
| crystalline polyester resin A5 | 9.09 | 81 | 130 | 40000 | 2 |
| crystalline polyester resin A6 | 11.37 | 90 | 110 | 11500 | 2 |
| crystalline polyester resin A7 | 9.11 | 83 | 132 | 42000 | 4 |
| crystalline polyester resin A8 | 10.00 | 75 | 106 | 18000 | 2 |
| crystalline polyester resin A9 | 11.77 | 110 | 100 | 42000 | 4 |

TABLE 2-continued

| | physical properties | | | | |
|---|---|---|---|---|---|
| | SP value (cal/cm$^3$)$^{1/2}$ | melting point ° C. | ⊿H J/g | weight-average molecular weight Mwa | acid value mgKOH/g |
| crystalline polyester resin A10 | 8.93 | 84 | 135 | 38000 | 2 |
| crystalline polyester resin A11 | 11.82 | 104 | 105 | 40000 | 2 |

<Production of Amorphous Polyester Resin B1>

A reaction vessel equipped with a nitrogen introducing tube, a dewatering tube, a stirrer and a thermocouple was charged with monomers, in the use amounts given in Table 3, and dibutyltin, as a catalyst, was added thereafter in an amount of 1.5 parts by mass with respect to 100 parts by mass of the total monomer amount. Next, the temperature was rapidly raised up to 180° C. in a nitrogen atmosphere at normal pressure, and thereafter, polycondensation was carried out by distilling water off while under heating from 180° C. up to 210° C. at a rate of 10° C./hour. Once the temperature reached 210° C., the interior of the reaction vessel was depressurized down to 5 kPa or less, and polycondensation was carried out under conditions of 210° C. and 5 kPa or less, to yield amorphous polyester resin B1. The polymerization time was adjusted herein in such a manner that the softening point of the obtained polyester resin B1 took on the value given in Table 4. The physical properties of amorphous polyester resin B1 are given in Table 4.

<Production of Amorphous Polyester Resins B2 to B3 and B6 to B14>

Amorphous polyester resins B2 to B3 and B6 to B14 were obtained in the same way as in amorphous polyester resin B1, but herein the monomers and the use amounts were modified as set out in Table 3. The physical properties of the amorphous polyester resins are given in Table 4.

<Production of Amorphous Polyester Resins B4 and B5>

A reaction vessel equipped with a nitrogen introducing tube, a dewatering tube, a stirrer and a thermocouple was charged with monomers (acid component and alcohol component), in the use amounts given in Table 3, and dibutyltin, as a catalyst, was added thereafter in an amount of 1.5 parts by mass with respect to 100 parts by mass of the total monomer amount. Next, the temperature was rapidly raised up to 180° C. in a nitrogen atmosphere at normal pressure, and thereafter polycondensation was carried out by distilling water off while under heating from 180° C. up to 210° C. at a rate of 10° C./hour. Once the temperature reached 210° C., the interior of the reaction vessel was depressurized down to 5 kPa or less, and polycondensation was carried out under conditions of 210° C. and 5 kPa or less. Thereafter, the pressure was reverted to normal pressure, the components that make up the functional group C given in Table 3 were added, and condensation was performed under conditions of 210° C. and 5 kPa or less, to yield amorphous polyester resins B4 and B5. The physical properties of the amorphous polyester resins are given in Table 4.

TABLE 3

| | Acid (mol %) | | | | | Alcohol (mol %) | | | | | functional group C | |
|---|---|---|---|---|---|---|---|---|---|---|---|---|
| | Monomer | | | | | | | | | | | |
| | TPA | IPA | TMA | MA | DSA | BPA-PO | BPA-EO | EG | PG | NPG | Compound | Addition amount |
| | SP value | | | | | | | | | | | |
| | 10.28 | 10.28 | 11.37 | 12.83 | 9.33 | 9.51 | 9.74 | 14.11 | 12.70 | 8.37 | (SP value) | (mol %) |
| Amorphous polyester resin B1 | 38.0 | 0.0 | 7.0 | 0.0 | 0.0 | 50.0 | 0.0 | 0.0 | 0.0 | 0.0 | n-octadecanoic acid (8.40) | 5.0 |
| Amorphous polyester resin B2 | 39.0 | 0.0 | 7.0 | 0.0 | 0.0 | 50.0 | 0.0 | 0.0 | 0.0 | 0.0 | 1-decanol (9.40) | 4.0 |
| Amorphous polyester resin B3 | 38.0 | 0.0 | 7.0 | 0.0 | 0.0 | 50.0 | 0.0 | 0.0 | 0.0 | 0.0 | n-octacosanoic acid (8.26) | 5.0 |
| Amorphous polyester resin B4 | 39.0 | 0.0 | 7.0 | 0.0 | 0.0 | 50.0 | 0.0 | 0.0 | 0.0 | 0.0 | 1,10-decanediol (9.84) | 4.0 |
| Amorphous polyester resin B5 | 38.0 | 0.0 | 7.0 | 0.0 | 0.0 | 50.0 | 0.0 | 0.0 | 0.0 | 0.0 | 1,28-octacosanedioic acid (8.26) | 5.0 |
| Amorphous polyester resin B6 | 39.0 | 0.0 | 7.0 | 0.0 | 0.0 | 50.0 | 0.0 | 0.0 | 0.0 | 0.0 | 1-octanol (9.69) | 4.0 |
| Amorphous polyester resin B7 | 38.0 | 0.0 | 7.0 | 0.0 | 0.0 | 50.0 | 0.0 | 0.0 | 0.0 | 0.0 | n-dotriacontanoic acid (8.23) | 5.0 |
| Amorphous polyester resin B8 | 39.0 | 0.0 | 7.0 | 0.0 | 0.0 | 50.0 | 0.0 | 0.0 | 0.0 | 0.0 | n-octatetracontanoic acid (8.16) | 4.0 |
| Amorphous polyester resin B9 | 38.0 | 0.0 | 7.0 | 0.0 | 0.0 | 28.0 | 10.0 | 15.0 | 0.0 | 0.0 | 1-octanol (9.69) | 2.0 |
| Amorphous polyester resin B10 | 42.0 | 0.0 | 1.0 | 0.0 | 0.0 | 46.0 | 0.0 | 0.0 | 0.0 | 0.0 | n-octatetracontanoic acid (8.16) | 11.0 |
| Amorphous polyester resin B11 | 20.0 | 8.0 | 0.0 | 0.0 | 12.0 | 35.0 | 25.0 | 0.0 | 0.0 | 0.0 | (comprised in DSA) | (12.0) |

TABLE 3-continued

| | Acid (mol %) | | | | | Alcohol (mol %) Monomer | | | | | functional group C | |
|---|---|---|---|---|---|---|---|---|---|---|---|---|
| | TPA | IPA | TMA | MA | DSA | BPA-PO | BPA-EO | EG | PG | NPG | Compound | Addition amount |
| | 10.28 | 10.28 | 11.37 | 12.83 | 9.33 | 9.51 | 9.74 | 14.11 | 12.70 | 8.37 | (SP value) | (mol %) |
| Amorphous polyester resin B12 | 39.0 | 0.0 | 7.0 | 0.0 | 0.0 | 50.0 | 0.0 | 0.0 | 0.0 | 0.0 | 1-hexanol (10.14) | 4.0 |
| Amorphous polyester resin B13 | 27.0 | 0.0 | 11.0 | 0.0 | 8.0 | 38.0 | 16.0 | 0.0 | 0.0 | 0.0 | (comprised in DSA) | (8.0) |
| Amorphous polyester resin B14 | 40.0 | 0.0 | 8.0 | 0.0 | 0.0 | 52.0 | 0.0 | 0.0 | 0.0 | 0.0 | — | — |

TPA: terephthalic acid
IPA; isophthalic acid
TMA; trimellitic acid
MA; maleic acid
DSA; dodecenylsuccinic acid
BPA-PO; bisphenol A-PO 2-mol adduct
BPA-EO; bisphenol A-EO 2-mol adduct
EG; ethylene glycol
PG; propylene glycol
NPG; neopentyl glycol

TABLE 4

| | SP value $(cal/cm^3)^{1/2}$ | weight-average molecular weight Mwb | Tg ° C. | softening point ° C. | acid value mgKOH/g |
|---|---|---|---|---|---|
| amorphous polyester resin B1 | 9.88 | 70000 | 65 | 120 | 10 |
| amorphous polyester resin B2 | 9.94 | 100000 | 68 | 121 | 12 |
| amorphous polyester resin B3 | 9.87 | 120000 | 70 | 125 | 11 |
| amorphous polyester resin B4 | 9.95 | 100000 | 68 | 121 | 11 |
| amorphous polyester resin B5 | 9.89 | 120000 | 70 | 124 | 13 |
| amorphous polyester resin B6 | 9.95 | 95000 | 62 | 120 | 10 |
| amorphous polyester resin B7 | 9.87 | 95000 | 70 | 120 | 11 |
| amorphous polyester resin B8 | 9.84 | 97000 | 72 | 120 | 11 |
| amorphous polyester resin B9 | 10.65 | 38000 | 60 | 121 | 14 |
| amorphous polyester resin B10 | 9.70 | 26000 | 73 | 116 | 7 |
| amorphous polyester resin B11 | 9.76 | 50000 | 60 | 120 | 7 |
| amorphous polyester resin B12 | 9.97 | 88000 | 65 | 120 | 12 |
| amorphous polyester resin B13 | 9.94 | 250000 | 62 | 135 | 10 |

TABLE 4-continued

| | SP value $(cal/cm^3)^{1/2}$ | weight-average molecular weight Mwb | Tg ° C. | softening point ° C. | acid value mgKOH/g |
|---|---|---|---|---|---|
| amorphous polyester resin B14 | 9.97 | 89000 | 65 | 122 | 12 |

Example 1

| | |
|---|---|
| Crystalline polyester resin A1 | 10.0 parts by mass |
| Amorphous polyester resin B1 | 90.0 parts by mass |
| Carbon black | 5.0 parts by mass |
| Fischer-Tropsch wax (DSC peak temperature: 105° C.) | 5.0 parts by mass |
| Aluminum 3,5-di-t-butylsalicylate compound | 0.5 parts by mass |

The above materials were mixed in a Henschel mixer (FM-75, by Mitsui Miike Chemical Engineering Machinery, Co., Ltd.), and thereafter the resulting mixture was kneaded under conditions of rotational speed 3.3 $s^{-1}$ and kneading temperature of 130° C., using a twin-screw kneader (PCM-30, by Ikegai Corp.). The obtained kneaded product was cooled, and was coarsely pulverized, to 1 mm or less, using a hammer mill, to yield a coarsely pulverized product. The obtained coarsely pulverized product was finely pulverized in a mechanical grinder (T-250, by Turbo Kogyo Co., Ltd.). The resulting finely pulverized powder was classified using a multi-grade classifier that relied on the Coanda effect, to yield negatively triboelectrically chargeable toner particles having a weight-average particle diameter (D4) of 7.0 μm.

| | |
|---|---|
| Obtained toner particles | 100.0 parts by mass |
| Titanium oxide fine particles surface-treated with 15.0 mass % of isobutyl trimethoxysilane and having a primary average particle size of 50 nm | 1.0 part by mass |

-continued

| | |
|---|---|
| Hydrophobic silica fine particles surface-treated with 20.0 mass % of hexamethyldisilazane and having a primary average particle size of 16 nm | 0.8 parts by mass |

The above materials were charged in a Henschel mixer (FM-75, by Mitsui Miike Chemical Engineering Machinery, Co., Ltd.) and were mixed, to yield toner 1.

The various physical properties of toner 1 are given in Table 5.

The toner produced in the present example was evaluated as described below. A commercially available color laser printer, Color Laser Jet CP4525 (by HP) was used for evaluation.

Evaluation using toner 1 yielded good results in all evaluation items.

(1) Low-Temperature Fixability in High-Speed Development

A fixing unit was removed from the evaluation apparatus, and an external fixing unit was used instead in which the fixation temperature, the fixing nip and the process speed of the fixing apparatus could be arbitrarily set. Laser copier paper (by Canon Inc., 80 g/m$^2$) was used as the recording medium. A toner product was then removed from a commercially available black cartridge, the interior of the cartridge was cleaned with an air brush, and then the cartridge was filled with 150 g of toner 1. Magenta, yellow and cyan cartridges, having had the respective toner product removed therefrom, and having had a toner residual amount detecting mechanism disabled, were inserted in the respective magenta, yellow and cyan stations.

An unfixed solid black image was outputted in such a manner that the toner carrying amount was 0.6 mg/cm$^2$ under an environment at a temperature of 23° C. and a relative humidity of 50%.

The fixation temperature of the fixing unit was modified to 140° C. and the fixing nip pressure to 0.10 MPa, and the above solid black unfixed image was fixed while the process speed was raised in 20 mm/sec increments, within a range of 300 mm/sec to 500 mm/sec.

Each solid black image thus obtained was subjected to five back-and-forth rubs, using a lens-cleaning paper, under a load of about 100 g, and the point at which the density decrease rate from before to after rubbing was 10% or less was taken as the highest process speed that allows for fixing. The higher this fixing-enabling highest process speed, the better the low-temperature fixability of the toner is during high-speed development. The evaluation results are given in Table 6. In the present invention, a rating of C or better corresponds to an allowable level.

A: fixing-enabling highest process speed of 500 mm/sec.

B: fixing-enabling highest process speed ranging from 400 mm/sec to 480 mm/sec.

C: fixing-enabling highest process speed ranging from 300 mm/sec to 380 mm/sec.

D: fixing-enabling highest process speed of 280 mm/sec or lower.

(2) Gloss Unevenness Test of Fixed Images

In the above fixing test, 10 prints of an image were consecutively outputted, using thick GF-C104 paper (by Canon Inc., 104 g/m$^2$), under settings of fixation temperature 160° C., fixing nip pressure 0.10 MPa and process speed 200 mm/sec. The gloss (gloss value) (%) of the first and the last image were measured.

Gloss (gloss value) was measured herein using a Handy Gloss Meter PG-1 (by NIPPON DENSHOKU INDUSTRIES Co., LTD). The light projection angle and the light-receiving angle for measurement were both adjusted to 75°.

In the gloss unevenness test, the gloss at a total of 20 points, namely 10 points each of the first and tenth outputted images, were measured, and unevenness was evaluated as the difference between the highest gloss and the lowest gloss. The evaluation criteria were as set forth below. The evaluation results are given in Table 6. In the present invention, a rating of C or better corresponds to an allowable level.

A: gloss difference smaller than 2%

B: gloss difference from 2% to less than 5%

C: gloss difference from 5% to less than 7%

D: gloss difference of 7% or greater (3) Long-Term Storage Stability

As an evaluation method of long-term storage stability, a 1 kg load was placed on a bag (Sunzip D-4 bag, by C.I. KASEI CO., LTD.) filled with 10 g of evaluation sample, and the whole was left to stand for one month in an environment at a temperature of 45° C. and humidity of 5%. After one month, the evaluation sample was left to stand overnight in an environment at a temperature of 23° C. and humidity of 60%.

The measurement method involved setting the toner for evaluation on a set 200-mesh sieve (sieve opening 77 μm), adjusting the value of displacement of a digital vibration meter to 0.50 mm (peak-to-peak), and imparting vibration for 30 seconds. Thereafter, the long-term storage stability was evaluated on the basis of the amount of toner aggregates that remained on the sieves. The evaluation results are given in Table 6. In the present invention, a rating of C or better corresponds to an allowable level.

A: toner residual amount on mesh no greater than 0.2 g

B: toner residual amount on mesh greater than 0.2 g, up to 0.5 g

C: toner residual amount on mesh greater than 0.5 g, up to 1.0 g

D: toner residual amount on mesh greater than 1.0 g, up to 1.5 g

E: toner residual amount on mesh greater than 1.5 g (4) High-Temperature High-Humidity Storage Stability Herein, a 1 kg load was placed on a bag (Sunzip D-4 bag, by C.I. KASEI CO., LTD.) filled with 10 g of evaluation sample, and the whole was left to stand for seven days in an environment at a temperature of 40° C. and humidity of 95%. After seven days, the evaluation sample was left to stand overnight in an environment at a temperature of 23° C. and humidity of 60%.

The measurement method was identical to the method in "(3) Long-term storage stability" above. Thereafter, high-temperature high-humidity storage stability was evaluated on the basis of the amount of toner aggregates that remained on the sieves. The evaluation results are given in Table 6. In the present invention, a rating of C or better corresponds to an allowable level.

A: toner residual amount on mesh no greater than 0.2 g

B: toner residual amount on mesh greater than 0.2 g, up to 0.5 g

C: toner residual amount on mesh greater than 0.5 g, up to 1.0 g

D: toner residual amount on mesh greater than 1.0 g

Examples 2 to 19

Toners 2 to 19 were obtained in the same way as in Example 1, but herein the material formulation was modified as set out in Table 5. The physical properties of toners 2 to 19 are given in Table 5. The toners were evaluated in the same way as in Example 1. The results are given in Table 6.

Comparative Examples 1 to 6

Toners 20 to 25 were obtained in the same way as in Example 1, but herein the material formulation was modified as set out in Table 5. The physical properties of toners 20 to 25 are given in Table 5. The toners were evaluated in the same way as in Example 1. The results are given in Table 6.

TABLE 5

| | | crystalline polyester resin A | | amorphous polyester resin B | | | | | toner properties | |
|---|---|---|---|---|---|---|---|---|---|---|
| | toner No. | No. | SP value (Sa) | No. | SP value (Sb) | C numbers in functional group | A:B | Sb − Sa | Tm (° C.) | Mw |
| Example 1 | toner 1 | A1 | 9.87 | B1 | 9.88 | C18 | 10:90 | 0.01 | 116 | 72000 |
| Example 2 | toner 2 | A2 | 10.10 | B2 | 9.94 | C10 | 10:90 | −0.16 | 116 | 100000 |
| Example 3 | toner 3 | A3 | 9.72 | B3 | 9.87 | C28 | 10:90 | 0.15 | 122 | 125000 |
| Example 4 | toner 4 | A2 | 10.10 | B4 | 9.95 | C10 | 10:90 | −0.15 | 116 | 100000 |
| Example 5 | toner 5 | A3 | 9.72 | B5 | 9.89 | C28 | 10:90 | 0.17 | 122 | 125000 |
| Example 6 | toner 6 | A2 | 10.10 | B6 | 9.95 | C8 | 10:90 | −0.15 | 116 | 96000 |
| Example 7 | toner 7 | A3 | 9.72 | B7 | 9.87 | C32 | 10:90 | 0.15 | 122 | 96000 |
| Example 8 | toner 8 | A4 | 10.39 | B6 | 9.95 | C8 | 10:90 | −0.44 | 114 | 96000 |
| Example 9 | toner 9 | A5 | 9.09 | B7 | 9.87 | C32 | 10:90 | 0.78 | 118 | 96000 |
| Example 10 | toner 10 | A5 | 9.09 | B8 | 9.84 | C48 | 10:90 | 0.75 | 118 | 98000 |
| Example 11 | toner 11 | A5 | 9.09 | B6 | 9.95 | C8 | 10:90 | 0.86 | 118 | 96000 |
| Example 12 | toner 12 | A6 | 11.37 | B8 | 9.84 | C48 | 10:90 | −1.53 | 110 | 98000 |
| Example 13 | toner 13 | A7 | 9.11 | B6 | 9.95 | C8 | 10:90 | 0.84 | 118 | 96000 |
| Example 14 | toner 14 | A7 | 9.11 | B9 | 10.65 | C8 | 10:90 | 1.54 | 120 | 39000 |
| Example 15 | toner 15 | A6 | 11.37 | B10 | 9.70 | C48 | 10:90 | −1.67 | 108 | 30000 |
| Example 16 | toner 16 | A6 | 11.37 | B8 | 9.84 | C48 | 5:95 | −1.53 | 116 | 96000 |
| Example 17 | toner 17 | A7 | 9.11 | B9 | 10.64 | C8 | 40:60 | 1.53 | 120 | 39000 |
| Example 18 | toner 18 | A6 | 11.37 | B8 | 9.84 | C48 | 3:97 | −1.53 | 116 | 96000 |
| Example 19 | toner 19 | A7 | 9.11 | B9 | 10.64 | C8 | 42:58 | 1.53 | 120 | 39000 |
| Comparative example 1 | toner 20 | A8 | 10.00 | B11 | 9.76 | C12 | 10:90 | −0.24 | 118 | 50000 |
| Comparative example 2 | toner 21 | A9 | 11.77 | B8 | 9.84 | C48 | 10:90 | −1.93 | 106 | 96000 |
| Comparative example 3 | toner 22 | A10 | 8.93 | B6 | 9.95 | C8 | 10:90 | 1.02 | 118 | 95000 |
| Comparative example 4 | toner 23 | A4 | 10.39 | B12 | 9.97 | C6 | 10:90 | −0.42 | 118 | 86000 |
| Comparative example 5 | toner 24 | A11 | 11.82 | B13 | 9.94 | C12 | 20:80 | −1.88 | 110 | 220000 |
| Comparative example 6 | toner 25 | A11 | 11.82 | B14 | 9.97 | — | 10:90 | −1.85 | 102 | 88000 |

TABLE 6

| | toner No. | low-temperature fixability (process speed) (mm/sec) | gloss unevenness | long-term storage stability (toner residual amount (g)) | high-temperature high-humidity storage stability (toner residual amount (g)) |
|---|---|---|---|---|---|
| Example 1 | toner 1 | A (500) | A (1%) | A (0) | A (0) |
| Example 2 | toner 2 | A (500) | A (1%) | A (0) | A (0) |
| Example 3 | toner 3 | A (500) | A (1%) | A (0) | A (0) |
| Example 4 | toner 4 | A (500) | A (1%) | A (0) | A (0) |
| Example 5 | toner 5 | A (500) | A (1%) | A (0) | A (0) |
| Example 6 | toner 6 | A (500) | A (1%) | A (0) | B (0.4) |
| Example 7 | toner 7 | A (500) | B (3%) | A (0) | A (0) |
| Example 8 | toner 8 | A (500) | A (1%) | B (0.4) | B (0.4) |
| Example 9 | toner 9 | B (440) | B (3%) | A (0) | A (0) |
| Example 10 | toner 10 | B (440) | B (3%) | A (0) | A (0) |
| Example 11 | toner 11 | B (440) | A (1%) | A (0.2) | B (0.4) |
| Example 12 | toner 12 | A (500) | B (3%) | C (1.0) | A (0) |
| Example 13 | toner 13 | B (440) | A (1%) | B (0.3) | B (0.4) |
| Example 14 | toner 14 | C (360) | A (1%) | B (0.3) | B (0.4) |
| Example 15 | toner 15 | A (500) | B (3%) | C (1.0) | A (0) |
| Example 16 | toner 16 | A (500) | B (3%) | C (1.0) | A (0) |
| Example 17 | toner 17 | C (360) | A (1%) | B (0.3) | B (0.4) |
| Example 18 | toner 18 | B (440) | B (3%) | C (1.0) | A (0) |
| Example 19 | toner 19 | C (360) | A (1%) | B (0.5) | B (0.4) |

TABLE 6-continued

| | toner No. | low-temperature fixability (process speed) (mm/sec) | gloss unevenness | long-term storage stability (toner residual amount (g)) | high-temperature high-humidity storage stability (toner residual amount (g)) |
|---|---|---|---|---|---|
| Comparative example 1 | toner 20 | B (420) | D (10%) | D (1.2) | D (1.4) |
| Comparative example 2 | toner 21 | B (420) | C (6%) | D (1.5) | B (0.5) |
| Comparative example 3 | toner 22 | D (280) | B (4%) | B (0.9) | C (0.8) |
| Comparative example 4 | toner 23 | B (420) | B (4%) | C (0.8) | D (1.4) |
| Comparative example 5 | toner 24 | B (420) | D (11%) | E (1.8) | C (1.0) |
| Comparative example 6 | toner 25 | B (420) | D (12%) | E (2.0) | D (1.6) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160758, filed Aug. 1, 2013, which is hereby incorporated by reference herein in its entirety.

What is claimed is:

1. A toner comprising a toner particle that contains a crystalline polyester resin A, an amorphous polyester resin B and a colorant, (1) wherein the crystalline polyester resin A has a polyester molecular chain having a nucleating agent segment at the terminal end thereof, and has an SP value (Sa) ((cal/cm$^3$)$^{1/2}$) ranging from 9.00 to 11.50, and (2) the amorphous polyester resin B has at least one functional group selected from the group consisting of (a) to (c):

(a) an aliphatic hydrocarbon group having 8 to 50 carbon atoms;

(b) a functional group of which an aliphatic alcohol having 8 to 50 carbon atoms has been bound by condensation; and (c) a functional group of which an aliphatic carboxylic acid having 9 to 51 carbon atoms has been bound by condensation.

2. The toner according to claim 1, wherein the Sa and an SP value (Sb) ((cal/cm$^3$)$^{1/2}$) of the amorphous polyester resin B satisfy Expression (1):

$$-1.50 \leq Sb - Sa \leq 1.50 \quad \text{Expression (1).}$$

3. The toner according to claim 1, wherein the nucleating agent segment is a segment derived from an aliphatic monoalcohol having 10 to 30 carbon atoms and/or an aliphatic monocarboxylic acid having 11 to 31 carbon atoms.

4. The toner according to claim 1, wherein a mass ratio of the crystalline polyester resin A and the amorphous polyester resin B (crystalline polyester resin A:amorphous polyester resin B) ranges from 5:95 to 40:60.

5. The toner according to claim 1, wherein the number of carbon atoms (C1) of the nucleating agent segment of the crystalline polyester resin A and the number of carbon atoms (C2) of the functional group of the amorphous polyester resin B satisfy Expression (2):

$$0.5 \leq C1/C2 \leq 3.0 \quad \text{Expression (2).}$$

6. The toner according to claim 1, wherein the content of a component that constitutes the functional group of the amorphous polyester resin B ranges from 2.0 mol % to 11.0 mol % of monomers that constitute the amorphous polyester resin B.

* * * * *